US005969680A

United States Patent [19]

Tsuru et al.

[11] Patent Number: 5,969,680

[45] **Date of Patent: *Oct. 19, 1999**

[54] ANTENNA DEVICE HAVING A RADIATING PORTION PROVIDED BETWEEN A WIRING SUBSTRATE AND A CASE

[75] Inventors: Teruhisa Tsuru; Harufumi Mandai; Koji Shiroki; Kenji Asakura, all of Nagaokakyo, Japan

[73] Assignee: Murata Manufacturing Co., Ltd., Japan

[ * ] Notice: This patent is subject to a terminal disclaimer.

[21] Appl. No.: 08/883,871

[22] Filed: Jun. 27, 1997

Related U.S. Application Data

[63] Continuation of application No. 08/707,094, Sep. 3, 1996, abandoned, which is a continuation of application No. 08/331,904, Oct. 31, 1994, abandoned.

[30] Foreign Application Priority Data

Oct. 11, 1994 [JP] Japan ..... 6-245587
Oct. 11, 1994 [JP] Japan ..... 6-245588

[51] Int. Cl.[6] ..... H01Q 1/38

[52] U.S. Cl. ..... 343/700 MS; 343/702

[58] Field of Search ..... 343/829, 700 MS, 343/853, 702, 850, 846, 872; H01Q 7/38

[56] References Cited

U.S. PATENT DOCUMENTS

| | | | |
|---|---|---|---|
| 4,575,725 | 3/1986 | Tresselt | 343/700 |
| 4,701,763 | 10/1987 | Yamamoto et al. | 343/702 X |
| 4,724,443 | 2/1988 | Nysen | 343/700 |
| 4,728,962 | 3/1988 | Kitsuda et al. | 343/702 X |
| 4,749,996 | 6/1988 | Tresselt | 343/700 MS |
| 4,876,552 | 10/1989 | Zalman | 343/702 |
| 4,924,237 | 5/1990 | Honda et al. | 343/702 |
| 4,987,425 | 1/1991 | Zahn et al. | 343/700 MS |
| 5,023,621 | 6/1991 | Ushiyama et al. | 343/702 |
| 5,023,624 | 6/1991 | Heckaman et al. | 343/860 |
| 5,200,756 | 4/1993 | Feller | 343/700 MS |
| 5,281,974 | 1/1994 | Kuramoto et al. | 343/700 MS |
| 5,394,160 | 2/1995 | Iwasaki et al. | 343/702 |
| 5,406,292 | 4/1995 | Schnetzer et al. | 343/700 |
| 5,434,579 | 7/1995 | Shima et al. | 343/700 |
| 5,510,802 | 4/1996 | Tsuru et al. | 343/700 |
| 5,537,123 | 7/1996 | Mandai et al. | 343/700 |

FOREIGN PATENT DOCUMENTS

| | | |
|---|---|---|
| 2553586 | 4/1985 | European Pat. Off. . |
| 0246026 | 11/1987 | European Pat. Off. . |
| 0366393 | 5/1990 | European Pat. Off. . |
| 0400872 | 12/1990 | European Pat. Off. . |
| 0526643 | 2/1993 | European Pat. Off. . |
| 0621653 | 10/1994 | European Pat. Off. . |
| 0707354 | 4/1996 | European Pat. Off. . |

OTHER PUBLICATIONS

European Search Report on European Patent Application No. EP–95–11–4485; Jan. 30, 1996.

European Search Report on European Patent Application No. EP–95–11–5886; Jan.30, 1996.

European Search Report on European Patent Application No. EP–96–10–5722; Apr.4, 1997.

Small Antennas, K. Fujimoto et al., Research Studies Press Ltd., 1987, pp. 116–119, 147, and 197–199.

Microstrip Antennas, I.J. Bahl et al., Artech House, Inc., 1980, pp.26–29.

*Primary Examiner*—Don Wong
*Assistant Examiner*—Tho Phan
*Attorney, Agent, or Firm*—Ostrolenk, Faber, Gerb & Soffen, LLP

[57] ABSTRACT

An antenna device having a power supplying portion 52 mounted on a main wiring substrate 53*a* and a radiating portion 56*a* provided in a space between the main wiring substrate 53*a* and the inner surface of a sheathing case 55, the lower surface of the radiating portion 56*a* being opposed to the power supplying portion 52.

12 Claims, 14 Drawing Sheets

ANTENNA DEVICE HAVING A RADIATING PORTION PROVIDED BETWEEN A WIRING SUBSTRATE AND A CASE

This is a Continuation of application Ser. No. 08/707,094, filed on Sep. 3, 1996, now abandoned, which is a continuation of application Ser. No. 08/331,904 filed on Oct. 31, 1994 now abandoned.

BACKGROUND OF THE INVENTION

1. Field of the Invention

The present invention relates generally to an antenna device, and more particularly, to an antenna device used for a mobile communication equipment such as a portable telephone set.

2. Description of the Prior Art

An antenna device superior in characteristics such as gain and reflection lose has been required. In addition, as an antenna device used for a mobile communication equipment, a smaller antenna device than conventional antenna devices is required.

As one example of the conventional antenna devices, an inverted-F antenna is described in "Small Antennas" (Research studies press Ltd., England) by K. Fujimoto, A. Henderson, K. Hirasawa and J. R. James. The inverted-F antenna is illustrated in FIG. 18. In FIG. 18, an inverted-F antenna 71 has a rectangular metal plate 72 functioning as a radiating portion. The metal plate 72 is bent so as to be orthogonal to the metal plate 72 from its one side edge, to form a ground terminal 73. On the other hand, the metal plate 72 is similarly bent from its other side edge, to form a power supplying terminal 74. Since the inverted-F antenna 71 has the foregoing structure, the inverted-F antenna 71 can be mounted on a wiring substrate by inserting the ground terminal and the power supplying terminal into through holes provided on the wiring substrate. Since the gain of the inverted-F antenna 71 is not sufficiently large, however, it is difficult to reduce the size of the metal plate 72. As a result, it is difficult to miniaturize the inverted-F antenna 71.

3. Description of the Related Art

In order to solve the problem of the above described inverted-F antenna 71, a substrate surface mounted type antenna having a dielectric substrate has been proposed in copending U.S. patent application Ser. No. 08/230,857 filed in the U.S. Patent Office, which has not been known to the public yet. One example of the surface mounted type antenna is illustrated in FIG. 4. In addition, a surface mounted type antenna constructed by carrying an antenna switch circuit in addition to the antenna shown in FIG. 4 will be described with reference to FIGS. 5 to 8.

Referring to FIG. 4, a surface mounted type antenna 13 comprises a rectangular parallelepiped dielectric substrate 1 composed of ceramics or synthetic resin. Ground electrodes 2 are formed on both side surfaces on the side of the long sides of the dielectric substrate 1. On the other hand, connecting electrodes 3*a*, 3*b* and 3*c* are formed on both side surfaces on the side of the short sides of the dielectric substrate 1. The antenna device further comprises a metal chassis 4 composed of a metal material such as copper or a copper alloy so as to be combined with the dielectric substrate 1. The metal chassis 4 has a rectangular plate-shaped radiating portion 5 and two fixing portions 6 and 7 constructed by bending the radiating portion 5 downward from both ends on the side of its short sides. A power supplying terminal 8 and a ground terminal 9 are integrally formed in an end of the fixing portion 6. The length in the vertical direction of the fixing portion 6 is made smaller than the length in the vertical direction of the fixing portion 7 by the length in the vertical direction of the power supplying terminal 8 and the ground terminal 9. In addition, the length in the vertical direction of the fixing portion 6 including the power supplying terminal 8 and the ground terminal 9 and the length in the vertical direction of the fixing portion 7 are respectively made larger than the thickness of the dielectric substrate 1.

In the surface mounted type antenna 13 shown in FIG. 4, the dielectric substrate 1 is inserted into the metal chassis 4. The side surfaces on the side of the short sides of the dielectric substrate 1 respectively abut against the inner surfaces of the fixing portions 6 and 7 of the metal chassis 4, while a space 10 is formed between the radiating portion 5 of the metal chassis 4 and the surface of the dielectric substrate 1. The space 10 is formed by the dimensional difference between the respective lengths in the vertical direction of the fixing portion 6 having the power supplying terminal 8 and the ground terminal 9 provided therein and the fixing portion 7 and the thickness of the dielectric substrate 1. The connecting electrode 3*a* formed on the dielectric substrate 1 and the fixing portion 7 of the metal chassis 4 and the connecting electrodes 3*b* and 3*c* formed on the dielectric substrate 1 and the power supplying terminal 8 and the ground terminal 9 of the metal chassis 4 are respectively joined to each other by solder.

Furthermore, the above described surface mounted type antenna 13 is mounted on a main wiring substrate 15. On the main wiring substrate 15, a microstrip line 16 for supplying power to an antenna which is connected to an antenna switch circuit (not shown) serving as an antenna circuit, for example, and a ground electrode 17*a* which is electrically insulated from the microstrip line 16 are formed. Further, a ground electrode 17*b* is formed on almost the whole reverse surface of the main wiring substrate 15.

In the case of mounting, the surface mounted type antenna 13 is disposed on the surface of the main wiring substrate 15. The power supplying terminal 8 and the microstrip line 16 are soldered to each other, and the ground electrodes 2 and the ground terminal 9 are soldered to the ground electrode 17*a* on the surface of the main wiring substrate 15. The surface mounted type antenna 13 is thus surface mounted on the surface of the main wiring substrate 15. Radio waves are transmitted to and received from the radiating portion 5 of the metal chassis 4.

In a surface mounted type antenna 35 having an antenna switch circuit 24 shown in FIGS. 5 and 6, a rectangular plate-shaped dielectric substrate 21 having a multilayer structure composed of ceramics or synthetic resin is used. A transmission input portion TX, a receiving output portion RX, control input portions VC1 and VC2 and a plurality of ground electrodes 22 of the antenna switch circuit 24 are formed as outer electrodes on both side surfaces on the side of the long sides of the dielectric substrate 21, while connecting electrodes 23*a* to 23*c* are formed on both side surfaces on the side of the short sides thereof. In addition, a strip line 24*a*, a capacitor 24*b* and the like are formed as circuit elements inside the dielectric substrate 21, while a diode 24*c*, a resistor 24*d* formed by printing and the like are carried as circuit elements on the surface of the dielectric substrate 21. The circuit elements constitute the antenna switch circuit 24. An antenna output portion 24*e* of the antenna switch circuit 24 inside the dielectric substrate 21 leads to a side surface of the dielectric substrate 21, and is connected to the connecting electrode 23*b* formed on the side surface. Further, the circuit elements are electrically connected to each other by a suitable inner electrode or a via hole electrode.

A metal chassis 26 is used in combination with the above described dielectric substrate 21. The metal chassis 26 is composed of a metal material such as copper or a copper alloy. The metal chassis 26 has a rectangular plate-shaped radiating portion 27 and two fixing portions 28 and 29 formed by bending the radiating portion 27 downward from both ends on the side of its short sides. A power supplying terminal 30 and a ground terminal 31 are integrally formed in an and or the fixing portion 28. The length in the vertical direction of the fixing portion 28 is made smaller than the length in the vertical direction of the fixing portion 29 by the length in the vertical direction of the power supplying terminal 30 and the ground terminal 31. In addition, the length in the vertical direction of the fixing portion 28 including the power supplying terminal 30 and the ground terminal 31 and the length in the vertical direction of the fixing portion 29 are respectively made larger than the thickness of the dielectric substrate 21.

In the surface mounted type antenna 35 shown in FIG. 6, the dielectric substrate 21 is inserted into the metal chassis 26 in the case of assembling. The side surfaces on the side of the short sides of the dielectric substrate 21 respectively abut against the inner surfaces of the fixing portions 28 and 29 of the metal chassis 26, while a space 32 is formed between the radiating portion 27 of the metal chassis 26 and the surface of the dielectric substrate 21. The space 32 is formed by the dimensional difference between the respective lengths in the vertical direction of the fixing portion 28 including the power supplying terminal 30 and the ground terminal 31 and the fixing portion 29 and the thickness of the dielectric substrate 21. The connecting electrode 23*a* formed on the dielectric substrate 21 and the fixing portion 29 of the metal chassis 26 and the connecting electrodes 23*b* and 23*c* formed on the dielectric substrate 21 and the power supplying terminal 30 and the ground terminal 31 of the metal chassis 26 are respectively joined to each other by solder.

In FIG. 5, connecting electrodes 37 to 40 and a ground electrode 41*a* electrically insulated from the connecting electrodes 37 to 40 are formed on the surface of a main wiring substrate 36. A ground electrode 41*b* is formed on almost the whole reverse surface of the main wiring substrate 36.

The substrate surface mounted type antenna 35 is disposed on the surface of the main wiring substrate 36. The transmission input portion TX, the receiving output portion RX and the control input portions VC1 and VC2 are soldered to the connecting electrodes 37 to 40. In addition, the ground electrodes 22 and the ground terminal 31 are soldered to the ground electrode 41*a*. The surface mounted type antenna 35 is thus surface mounted on the surface of the main wiring substrate 36. Radio waves are transmitted to and received from the radiating portion 27 of the metal chassis 26.

The construction of the antenna switch circuit 24 has been conventionally known. One example of the antenna switch circuit is illustrated in FIG. 7. FIG. 8 is a block diagram showing the antenna 35 having the antenna switch circuit. Another antenna circuit such as a low-pass filter or a band-pass filter can be carried in addition to the antenna switch circuit 24 shown in FIG. 7.

Also in the above described antennas 13 and 35 shown in FIGS. 4 and 5, experience has shown that the following relationship holds among the gain, the frequency bandwidth and the volume occupied by the antenna, so that the miniaturization of the antenna is contrary to higher gain and wider bands:

$$(\text{gain})\times(\text{frequency bandwidth})=(\text{constant})\times(\text{volume occupied by antenna})$$

Since in the above described substrate surface mounted type antenna 13 or 35 which has not been known yet, the volume occupied by the antenna is small, therefore, gain and band characteristics are not more satisfactory, an compared with a large-sized antenna. Therefore, it is considered that the gain and band characteristics can be enhanced if the substrate surface mounted type antenna 13 or 35 is increased in size. If the antenna 13 or 35 is increased in size, however, the antenna occupies a large area on the main wiring substrate, whereby the size of the whole mobile communication equipment is forced to be increased.

In order to reduce reflection loss, the impedance of the antenna must be so designed that impedance matching is achieved in the mobile communication equipment. However, the impedance of the conventional inverted-F antenna 71 is determined by the position of the power supplying terminal 74, the distance between the ground terminal 73 and the power supplying terminal 74, and the like. In order to set or finely adjust the impedance, therefore, the shape of the inverted-F antenna 71 itself must be changed, thereby to make it difficult to adjust the impedance.

Also in the substrata surface mounted type antenna 13 or 35, the impedance of the antenna is determined by the position of the power supplying terminal, the distance between the ground terminal and the power supplying terminal, and the like. In order to set or finely adjust the impedance, therefore, the shape of the antenna itself must be similarly changed, thereby to make it difficult to adjust the impedance.

Furthermore, in the surface mounted type antenna 13, the power supplying terminal 8, the ground electrodes 2 and the ground terminal 9 are respectively soldered to electrodes on the main wiring substrate 15, whereby the antenna 13 is surface mounted on the main wiring substrate 15. If the antenna 13 is mounted on the main wiring substrate 15 once, therefore, it is difficult to remove the antenna 13 thereafter. On the other hand, after the antenna 13 is surface mounted on the main wiring substrate 15, the power supplying terminal 8 is connected to the antenna switch circuit through the microstrip line 16. Consequently, the impedance of the antenna 13 itself is added to a transmission output from the antenna switch circuit, thereby to make it impossible to accurately measure the transmission output from the antenna switch circuit.

Also in the surface mounted type antenna 35, the transmission input portion TX, the receiving output portion RX, the control input portions VC1 and VC2, the ground electrode 22 and the ground terminal 31 are respectively soldered to electrodes on the main wiring substrate 36, whereby the antenna 35 is surface mounted on the main wiring substrate 36. After the antenna 35 is mounted on the substrate 36 once, therefore, it is difficult to remove the antenna 35. In addition, after the antenna 35 is surface mounted on the main wiring substrate 36, the power supplying terminal 30 is connected to the antenna output portion 24*e* of the antenna switch circuit 24. Consequently, the impedance of the antenna 35 itself is added to a transmission output from the antenna switch circuit 24, thereby to make it impossible to accurately measure the transmission output from the antenna switch circuit 24.

In order to accurately measure the transmission output from the antenna switch circuit after the antenna 13 or 35 is mounted on the main wiring substrate, therefore, an electrical or mechanical switch for switching the transmission output to a transmission output measuring terminal is required, resulting in increased costs.

SUMMARY OF THE INVENTION

The present invention has been made so as to overcome the disadvantages of the conventional inverted-F antenna and the surface mounted type antennas described above and has for its object to provide a new antenna device which can occupy a large volume and consequently, can achieve higher gain and wider bands without occupying a large area on a main wiring substrate and without changing the size of the whole of a mobile communication equipment, for example, incorporating the antenna device.

Another object of the present invention is to provide an antenna device whose impedance can be set and finely adjusted more simply.

Still another object of the prevent invention is to provide an antenna device which can easily and accurately measure a transmission output regulated by radio wave law, that is, a transmission output from an antenna circuit in a state where the antenna device is removed without using an electrical or mechanical switch for switching the transmission output to a transmission output measuring terminal even after the antenna device is mounted on a main wiring substrate.

In accordance with a wide aspect of the present invention, there is provided an antenna device having a main wiring substrate, a power supplying portion provided on the main wiring substrate, a sheathing case enclosing the main wiring substrate, and a plate-shaped radiating portion provided in a space between the main wiring substrate and the sheathing case, one surface of the plate-shaped radiating portion being opposed to the power supplying portion. In this construction, only the power supplying portion of the antenna device is provided on the main wiring substrate, and the radiating portion is not provided on the main wiring substrate. Consequently, it is possible to decrease the area occupied by the antenna device on the main wiring substrate. The radiating portion is provided in a space which has not been conventionally used, that is, the space between the main wiring substrate and the sheathing case. Consequently, the area of the radiating portion can be significantly increased without changing the size of the whole mobile communication equipment, thereby to make it possible to achieve higher gain and wider bands in the antenna device. Further, the position of the radiating portion in a case where one surface of the radiating portion is opposed to the power supplying portion, thereby to make it possible to change the resonance frequency and the impedance characteristics of the antenna device. Therefore, it is possible to reduce reflection loss. Accordingly, the shapes of the power supplying portion and the radiating portion themselves need not be changed in setting or finely adjusting the impedance of the antenna device, thereby to make it possible to set or finely adjust the impedance more simply.

The power supplying portion and the radiating portion may be so provided as to be brought into contact with each other. Alternatively, the power supplying portion and the radiating portion may be provided spaced apart from each other by the distance at which they are electromagnetically connected to each other. If the power supplying portion and the radiating portion are so provided as to be brought into contact with each other, the power supplying portion and the radiating portion are electrically connected to each other. Consequently, a transmission radio wave output from the power supplying portion can be radiated from the radiating portion. On the other hand, even when the power supplying portion and the radiating portion are provided spaced apart from each other by the distance at which they are electromagnetically connected to each other, the power supplying portion and the radiating portion are electromagnetically connected to each other. Consequently, a transmission radio wave output from the power supplying portion can be radiated from the radiating portion.

In accordance with a particular aspect of the present invention, the above described substrate surface mounted type antennas 13 and 35 as shown in FIGS. 4 and 5 which have not been known yet can be used as the power supplying portion of the above described antenna device. In this case, the substrate surface mounted type antenna and the radiating portion are connected to each other electrically or electromagnetically, whereby the transmission radio wave output from the substrate surface mounted type antenna is radiated from the radiating portion.

In accordance with another particular aspect of the present invention, the main wiring substrate comprises a ground electrode, at least one edge of the radiating portion is bent toward the main wiring substrate, and the edge is in close proximity to the ground electrode. Consequently, the distance between the radiating portion and a portion at a ground potential is decreased, thereby to increase the stray capacitance of the radiating portion. Accordingly, it is possible to reduce the resonance frequency of the antenna device.

Furthermore, in the antenna device according to the present invention, a part or the whole of the power supplying portion is inserted into a hole formed in the main wiring substrate, thereby to make it possible to decrease the height of a portion, which is projected from the main wiring substrate, of the power supplying portion. In this case, the height of a portion, which is projected from the main wiring substrate, of the antenna device can be decreased, thereby to make it possible to decrease the height of the mobile communication equipment.

Furthermore, the radiating portion is preferably composed of a conductive material, whereby Joule loss in the radiating portion is reduced, thereby to make it possible to increase the gain of the antenna device.

In accordance with still another particular aspect of the present invention, the ground electrode is formed on one major surface of the main wiring substrate, which faces to the human body in the use, and the radiating portion is provided on a major surface on the opposite side of the one major surface. In this case, a transmission output to the human body can be attenuated by the shielding effect of the ground electrode. Consequently, it is possible to reduce the adverse effect on the human body.

In accordance with a further aspect of the present invention, the antenna device further comprises a capacitor connected to the power supplying portion and a transmission output measuring terminal connected to the power supplying portion through the capacitor. Consequently, the capacitance of the capacitor is added to the transmission output from the power supplying portion at the transmission output measuring terminal. As a result, the effect of the inductance of the power supplying portion on a measured value of the transmission output from the power supplying portion at the transmission output measuring terminal can be adjusted by the capacitance of the capacitor connected to the power supplying portion. Accordingly, it is possible to accurately measure the transmission output from the antenna circuit excluding the effect of the inductance of the power supplying portion. Moreover, in the antenna device according to the present invention, even after the power supplying portion is mounted on the main wiring substrate, it is possible to easily separate the radiating portion from the power supplying portion by removing the sheathing case from the main wiring substrate.

Even after the power supplying portion is provided on the main wiring substrate, therefore, it is possible to separate the radiating portion and easily and accurately measure the transmission output from the antenna circuit in a state where the antenna device is removed which is regulated by radio wave law. As a result, it is possible to easily check the level of the transmission output at the time of shipment.

Furthermore, an electrical or mechanical switch for switching the transmission output to the transmission output measuring terminal can be omitted, thereby to make it possible to reduce costs.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3A is a block diagram showing the antenna device using a power supplying portion, and FIG. 3B is a block diagram showing the antenna device using a substrate surface mounted type antenna;

FIG. 9A is a front view, and FIG. 9B is a side view;

FIG. 10 is a block diagram for explaining the electrical connection in the antenna device according to the second embodiment of the present invention, where

FIG. 11 is a diagram showing an antenna device according to a third embodiment of the present invention, to which a sheathing case is added, where

FIG. 12 is a diagram showing an antenna device according to a fourth embodiment of the present invention, to which a sheathing case is added, where

FIG. 13 is a diagram for explaining a modified example of the antenna device according to the fourth embodiment of the present invention, where

DESCRIPTION OF THE PREFERRED EMBODIMENTS

Non-restricted embodiments of the present embodiment will be described with reference to the drawings.

Figure 1A:
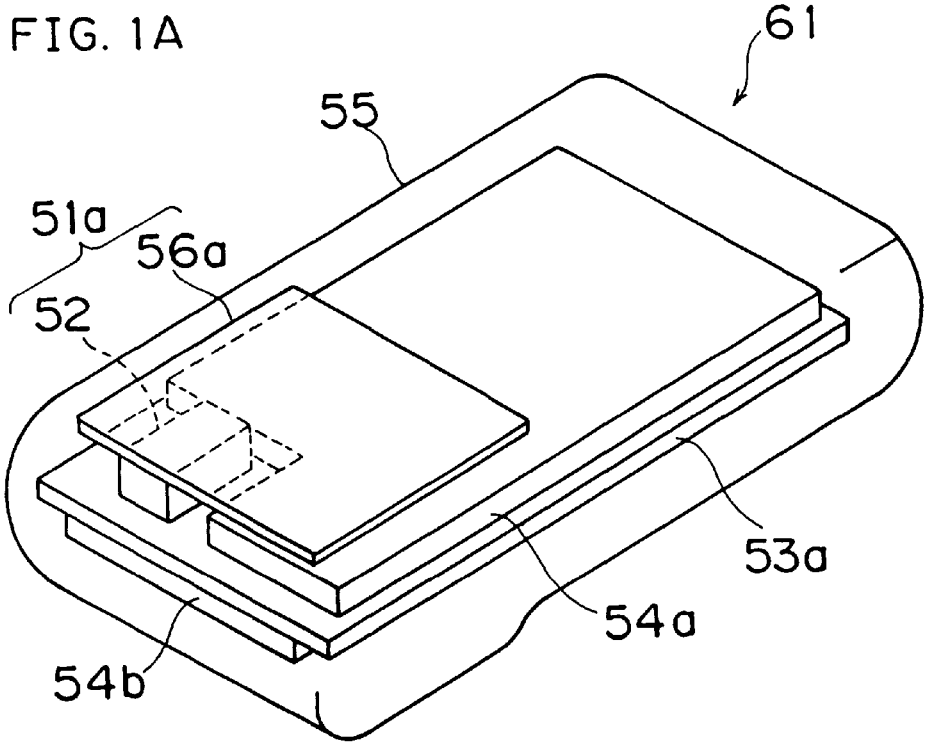
FIG. 1A is a perspective view showing an antenna device according to a first embodiment of the present invention, to which a sheathing case is added.
Figure 1B:
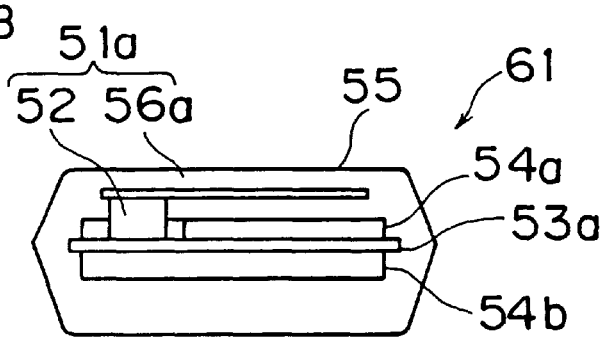
FIG. 1B is a front view showing the antenna device shown in FIG. 1A, to which the sheathing case is added.
Figure 1C:
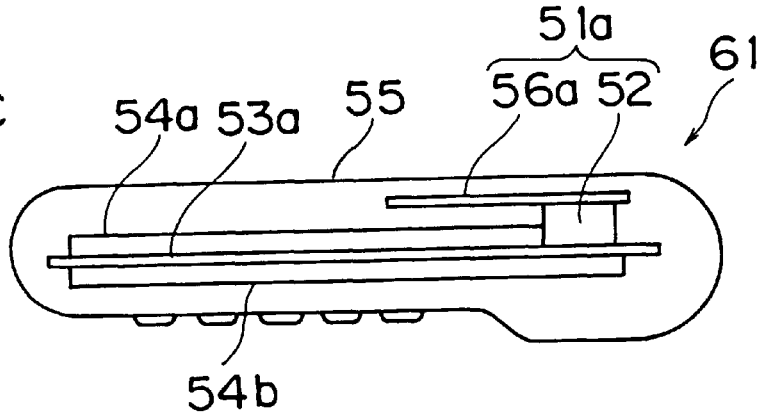
FIG. 1C is a side view showing the antenna device shown in FIG. 1A, to which the sheathing case is added.
Figure 2:
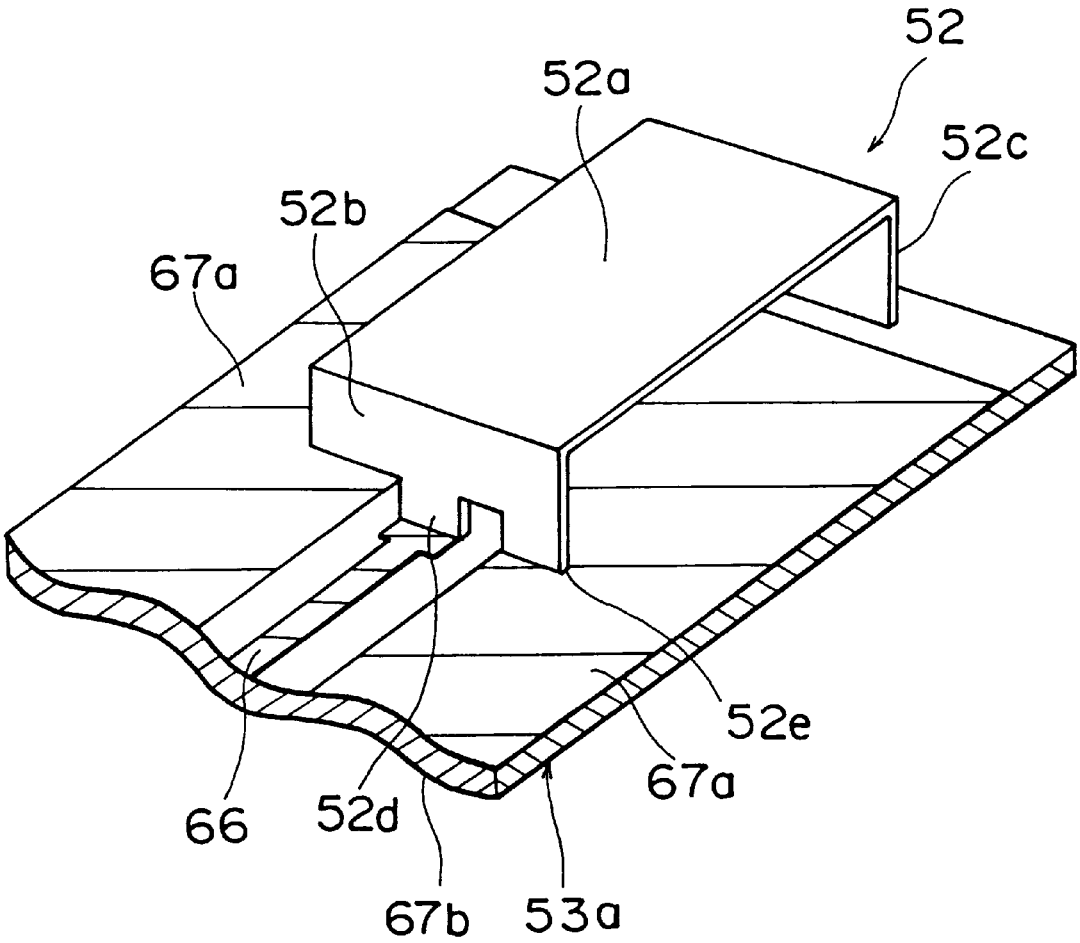
FIG. 2 is a partially cutaway view in perspective showing one example of a power supplying portion provided in the antenna device according to the first embodiment of the present invention.

FIGS. 1 and 2 illustrate an antenna device 51*a* according to a first embodiment and a power supplying portion 52 provided in the antenna device 51*a*. The antenna device 51*a* according to the present embodiment is contained in a portable telephone 61. FIG. 1A is a perspective view showing the internal structure of the portable telephone 61 looked through a sheathing case, FIG. 1B is a front view, FIG. 1C is a side view, and FIG. 2 is a partially cutaway view in perspective showing the power supplying portion 52.

The antenna device 51*a* has the power supplying portion 52, a main wiring substrate 53*a*, and a radiating portion 56*a*. In assembling the antenna device 51*a*, the power supplying portion 52 is arranged on the upper surface of the main wiring substrate 53*a*. As shown in FIG. 2, a microstrip line 66 for supplying power to an antenna is formed on the main wiring substrate 53*a*, and the power supplying portion 52 is connected to the microstrip line 66. The radiating portion 56*a* is arranged in a sheathing case 55. Specifically, the radiating portion 56*a* is arranged in a space formed between the main wiring substrate 53*a* and the sheathing case 55. The power supplying portion 52 is grounded to a ground electrode 67*a* formed on the main wiring substrate 53*a*, and the radiating portion 56*a* is grounded to the sheathing case 55. The lower surface of the radiating portion 56*a* is opposed to the power supplying portion 52. In the present embodiment, the lower surface of the radiating portion 56*a* is further brought into contact with the power supplying portion 52.

In order to protect the main wiring substrate 53*a,* shielding cases 54*a* and 54*b* are mounted on both surfaces of the main wiring substrate 53*a* so as to cover portions excluding a region where the power supplying portion 52 is disposed.

The power supplying portion 52 is composed of a metal material such as copper or a copper alloy. The power supplying portion 52 has a rectangular plate-shaped opposed portion 52*a*. The opposed portion 52*a* is parallel and opposed to the lower surface of the above described radiating portion 56*a,* and is brought into contact with the lower surface of the radiating portion 56*a*.

The opposed portion 52*a* is bent perpendicularly downward from both ends on the side of its short sides, thereby to form leg portions 52*b* and 52*c*. A power supplying terminal 52*d* and a ground terminal 52*e* are formed integrally with the leg portion 52*b* in an end of the leg portion 52*b*.

The ground electrode 67*a* is formed on the upper surface of the main wiring substrate 53*a* so as to be electrically insulated from the above described microstrip line 66. In addition, a ground electrode 67*b* is formed on almost the whole lower surface of the main wiring substrate 53*a*.

In mounting the power supplying portion 52 on the main wiring substrate 53*a,* the power supplying portion 52 is disposed on the surface of the main wiring substrate 53*a*. The power supplying terminal 52*d* and the microstrip line 66 are soldered to each other, while the ground terminal 52*e* is soldered to the ground electrode 67*e* on the upper surface of the main wiring substrate 53*a*. The power supplying portion 52 is thus surface mounted.

The shape of the power supplying portion 52 is not limited to one shown in FIG. 2. The power supplying portion 52 can be in a suitable shape, provided that it comprises at least one power supplying terminal 52*d* and at least one ground terminal 52*e* and it can electrically or electromagnetically transmit a transmission radio wave output to the radiating portion 56*a*. For example, the power supplying portion 52 may be constituted by a metal block. The positional relationship between the power supplying terminal 52*d* and the ground terminal 52*e* is not also limited to the relationship shown in FIG. 2. For example, the power supplying terminal 52*d* and the ground terminal 52*e* may be respectively formed in the different leg portions of the power supplying portion 52. Further, in order to reduce the resonance frequency of the antenna device 51*a,* capacitance may be added to the power supplying portion 52 by inserting a dielectric body into the power supplying portion 52.

Figure 3A:
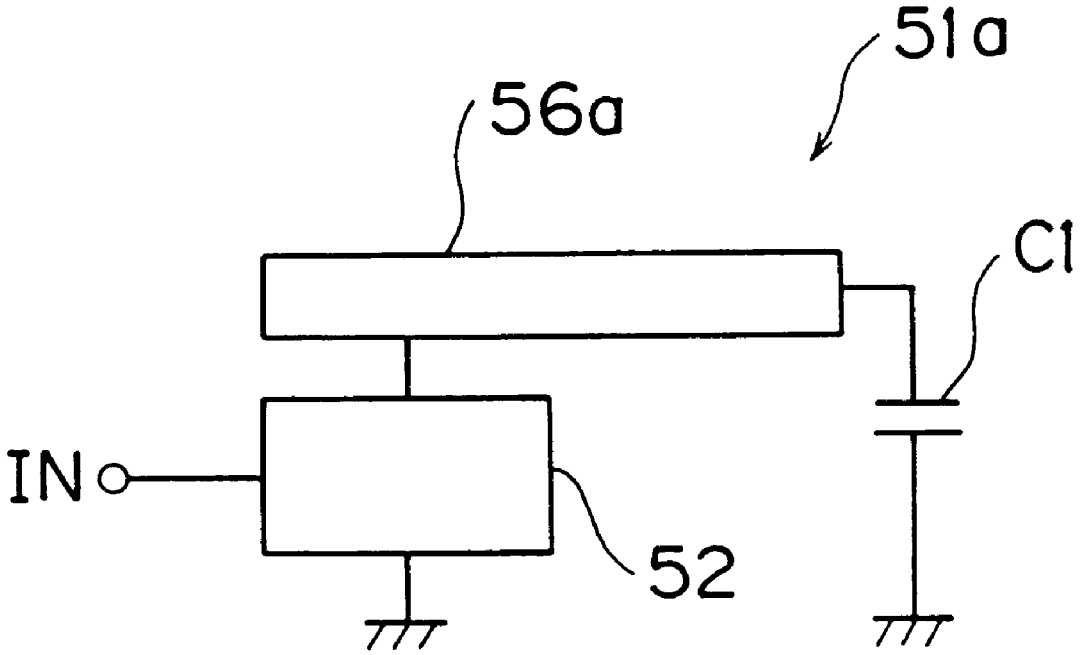
FIGS. 3A and 3B are respectively block diagrams for explaining the electrical connection in the antenna device according to the first embodiment, where

In the antenna device 51*a,* the power supplying portion 52 and the radiating portion 56*a* which are brought into contact with each other are electrically connected to each other, as shown in FIG. 3A. Consequently, a transmission radio wave output from the power supplying portion 52 is radiated from the radiating portion 56*a*. C1 in FIG. 3A denotes the stray capacitance of the radiating portion 56*a*.

In the antenna device 51*a* constructed as described above, only the power supplying portion 52 in the antenna device 51*a* is provided on the main wiring substrate 53*a,* and the radiating portion 56*a* is not provided thereon. Consequently, the antenna device 51*a* does not occupy a large area on the main wiring substrate 53*a*. Furthermore, the space between the main wiring substrate 53*a* and the sheathing case 55 is a space which has not been conventionally used. In the present embodiment, however, the radiating portion 56*a* is provided in the above described space. Consequently, the area of the radiating portion 56*a* can be significantly increased without changing the size of the whole portable telephone 61, thereby to make it possible to achieve higher gain and wider bands in the antenna device 51*a*.

Furthermore, the resonance frequency and the impedance characteristics of the antenna device 51*a* can be changed by selecting the position where the radiating portion 56*a* is opposed to the power supplying portion 52, thereby to make it possible to reduce reflection loss. In setting or finely adjusting the impedance of the antenna device 51*a,* therefore, the shapes of the power supplying portion 52 and the radiating portion 56*a* need not be changed, thereby to make it possible to set or finely adjust the impedance more simply, as compared with the conventional setting and fine adjustment. Further, Joule loss in the radiating portion 56*a* is reduced by composing the radiating portion 56*a* of a conductive material such as copper or a copper alloy, thereby to make it possible to increase the gain of the antenna device 51*a*. Further, if the radiating portion 56*a* is provided on a major surface on the opposite side of a major surface, which is in close proximity to the human body, of the main wiring substrate 53*a* having the ground electrodes 67*a* and 67*b,* a transmission output to the human body is attenuated by the shielding effect of the ground electrodes 67*a* and 67*b,* thereby to make it possible to reduce the effect on the human body.

Figure 3B:
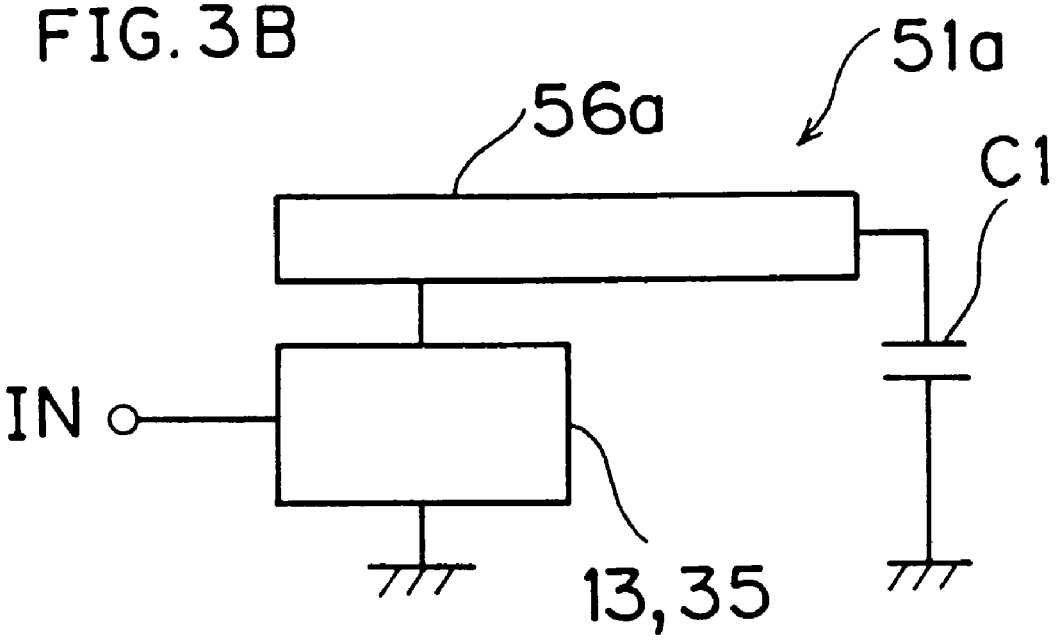
Figure 4:
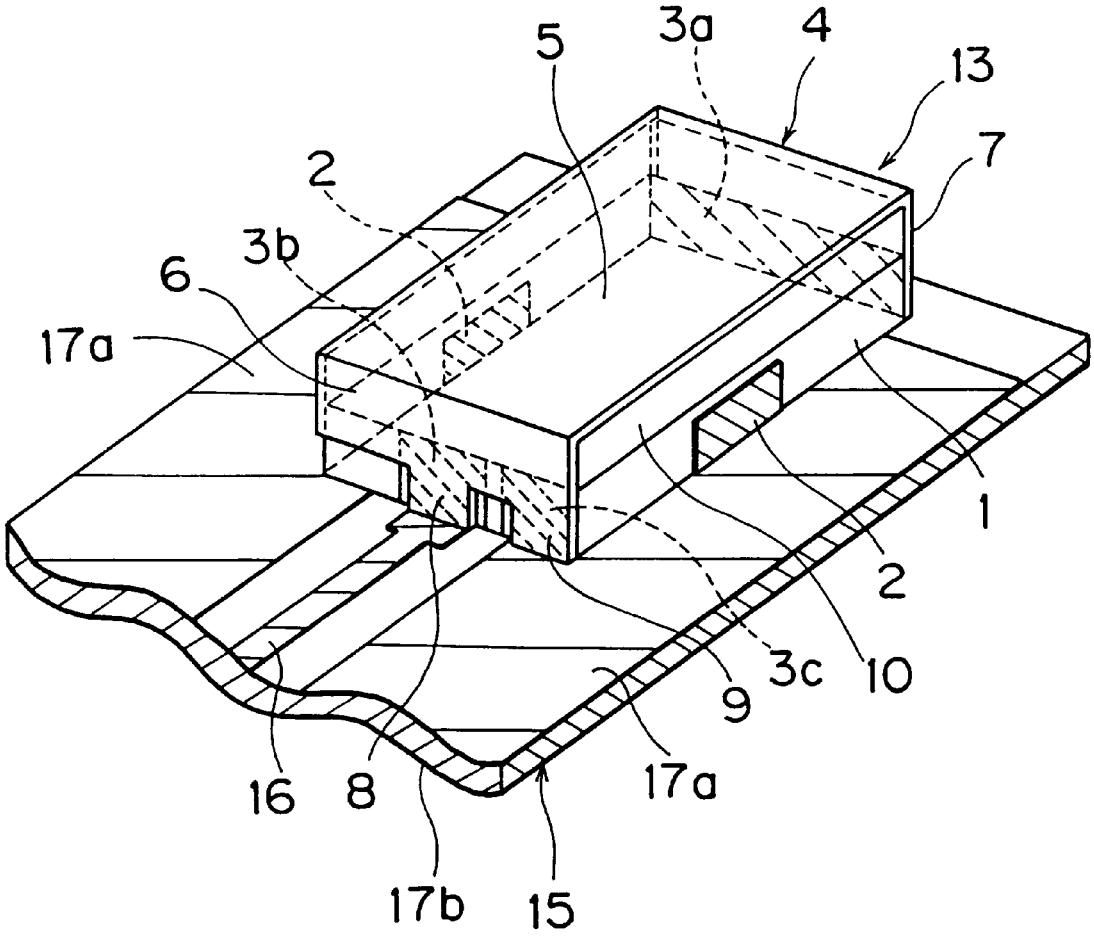
FIG. 4 is a perspective view showing a substrate surface mounted type antenna in one example which has not been known yet, which is used as a power supplying portion of the antenna device according to the present invention.
Figure 5:
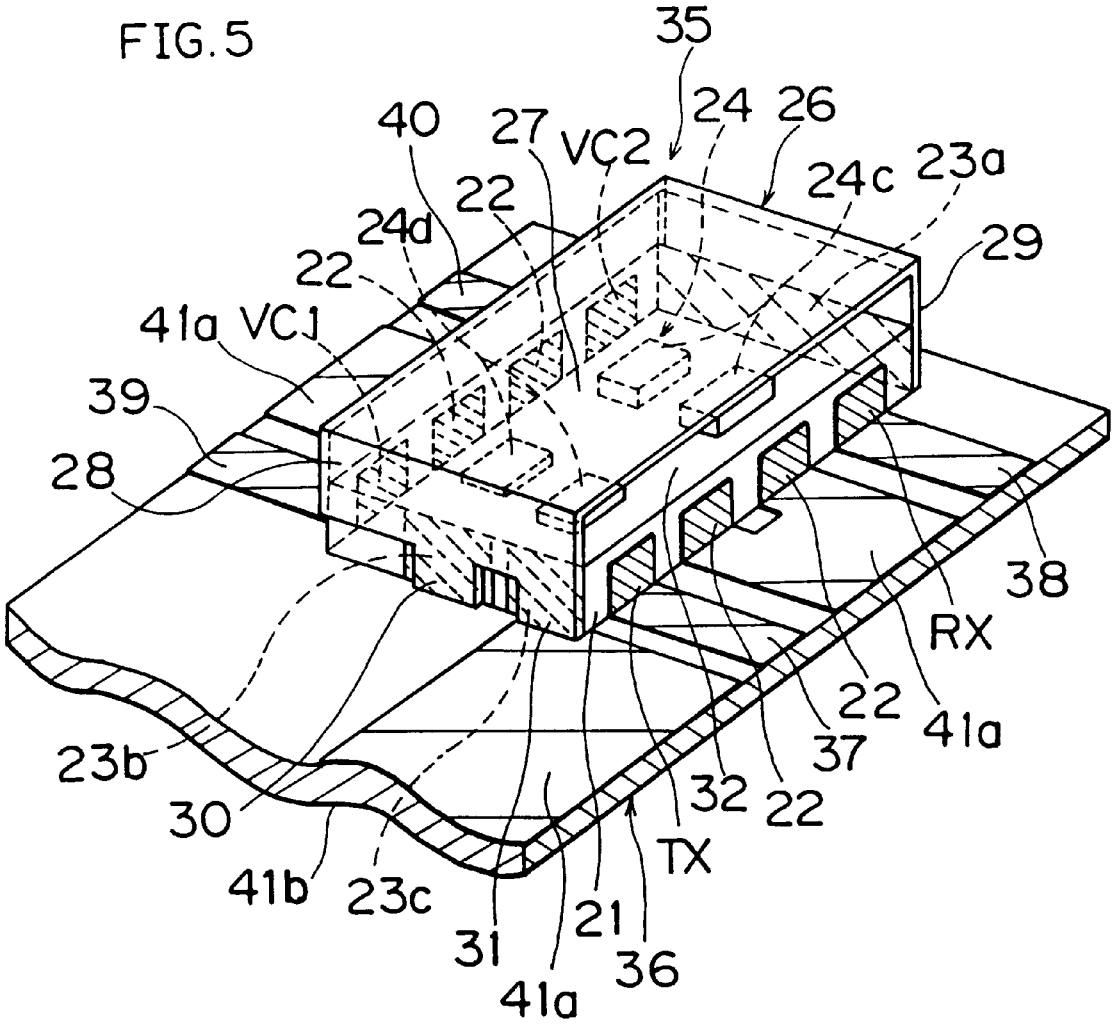
FIG. 5 is a partially cutaway view in a perspective showing a substrate surface mounted type antenna in another example which has not been known yet, that is, a substrate surface mounted type antenna containing an antenna switch circuit which can be used as a power supplying portion of the antenna device according to the present invention.
Figure 6:
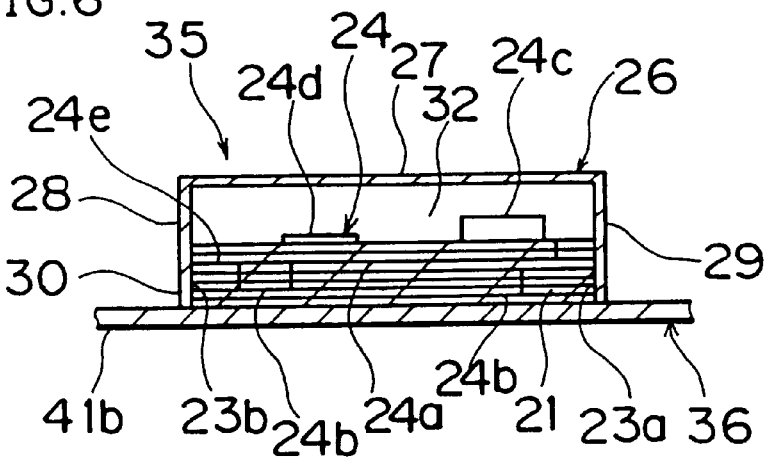
FIG. 6 is a cross sectional view showing the antenna shown in FIG. 5.
Figure 7:
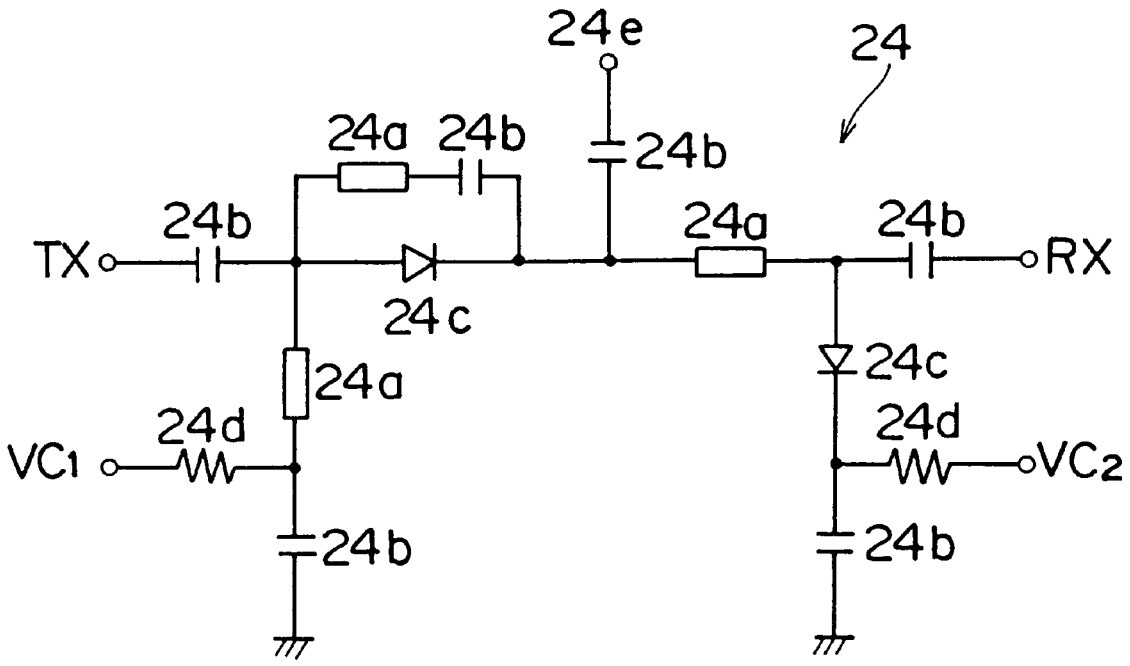
FIG. 7 is a circuit diagram showing the antenna switch circuit contained in the antenna shown in FIG. 5.
Figure 8:
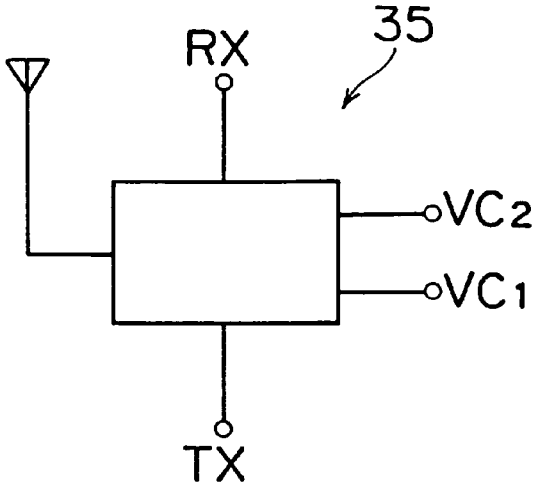
FIG. 8 is a block diagram showing the antenna shown in FIG. 5.

The above described power supplying portion 52 is not limited to one shown in FIG. 2. For example, the above described substrate surface mounted type antennas 13 and 35 which have not been known yet as shown in FIGS. 4 to 6 may be used. If the antenna 13 or 35 is used as the power supplying portion 52 in the present embodiment, the antenna is electrically connected to the radiating portion 56*a,* as shown in FIG. 3B, whereby a transmission radio wave output from the antenna is radiated from the radiating portion 56*a*. In such construction, the effect of the above described embodiment can be obtained directly using the above described substrate surface mounted type antenna 13 or 35.

Figure 9A:
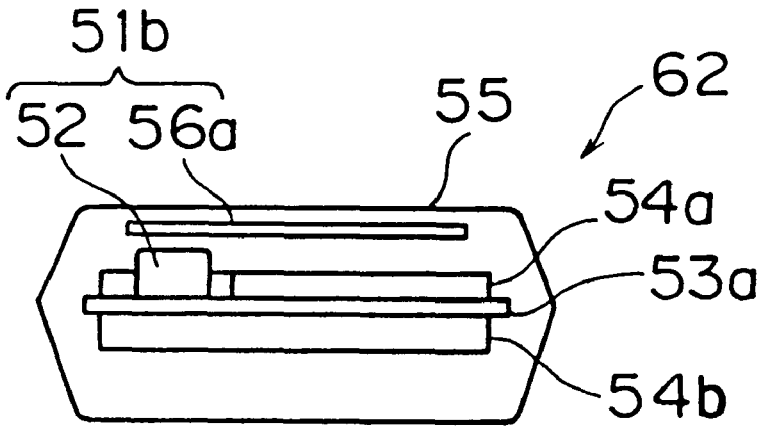
FIGS. 9A and 9B are diagrams showing an antenna device according to a second embodiment of the present invention, to which a sheathing case is added, where
Figure 9B:
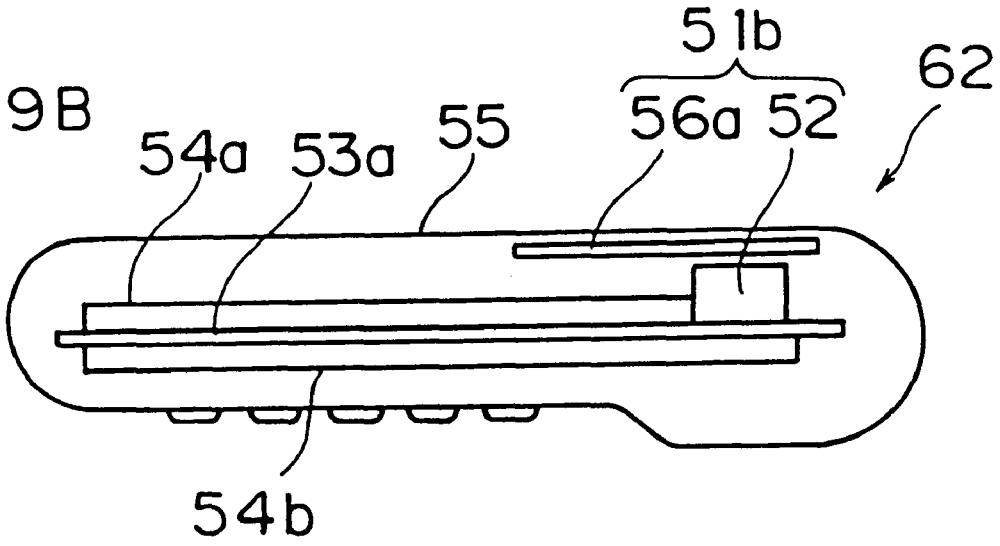

FIG. 9 is a diagram for explaining an antenna device 51*b* according to a second embodiment of the present invention. The antenna device 51*b* is contained in a portable telephone 62. FIG. 9A is a front view showing the internal structure of the portable telephone 62 looked through a sheathing case, and FIG. 9B is a side view showing the internal structure thereof looked through the sheathing case.

In FIGS. 9A and 9B, the description of the first embodiment is incorporated by assigning the same portions as those in the first embodiment the same reference numerals and hence, the detailed description thereof is not repeated.

In FIGS. 9A and 9B, in the antenna device 51*b,* a power supplying portion 52 and a radiating portion 56*a* are arranged spaced apart from each other by the distance at which they can be electromagnetically connected to each other.

Figure 10A:
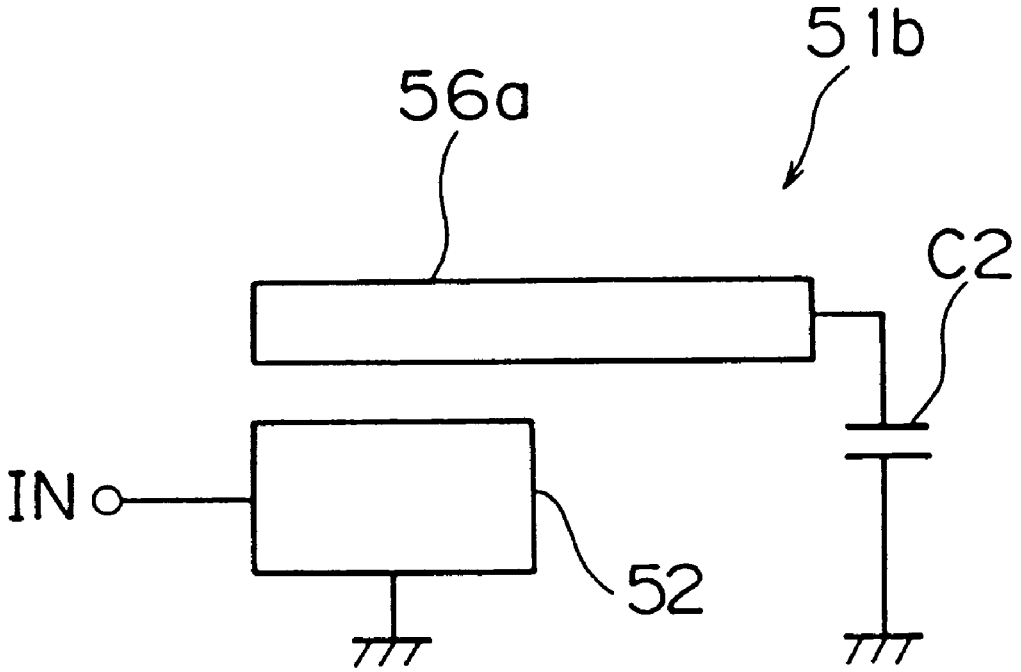
FIG. 10A is a block diagram showing the antenna device using a power supplying portion.

Consequently, the power supplying portion 52 and the radiating portion 56*a* are electromagnetically connected to each other by a magnetic field and stray capacitance in a space between the power supplying portion 52 and the radiating portion 56*a,* as shown in FIG. 10A. Therefore, a transmission radio wave output from the power supplying portion 52 is radiated from the radiating portion 56*a*. In FIG. 10A, C2 denotes the stray capacitance of the radiating portion 56*a*. In the embodiment shown in FIG. 9, the power supplying portion 52 and the radiating portion 56*a* are not electrically connected to each other because they are not brought into contact with each other. Since they are electromagnetically connected to each other as described above, however, the same effect as that of the antenna device 51*a* according to the first embodiment is produced.

Figure 10B:
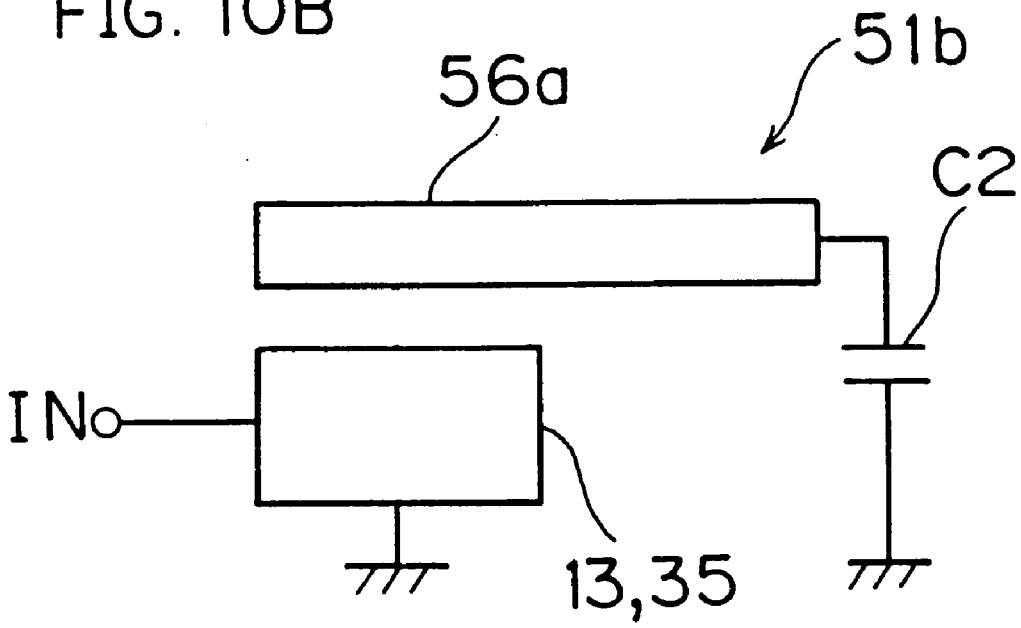
FIG. 10B is a block diagram showing the antenna device using as a power supplying portion a substrate surface mounted type antenna.

Also in the second embodiment, as the power supplying portion 52, the substrate surface mounted type antennas 13 and 35 described with reference to FIGS. 4 to 8 can be used. In this case, the antenna 13 or 35 and the radiating portion 56*a* are electromagnetically connected to each other by a magnetic field and stray capacitance in a space between the antenna 13 or 15 and the radiating portion 56*a,* as shown in FIG. 10B. Therefore, a transmission radio wave output from the antenna 13 or 35 is radiated from the radiating portion 56*a.*

Figure 11A:
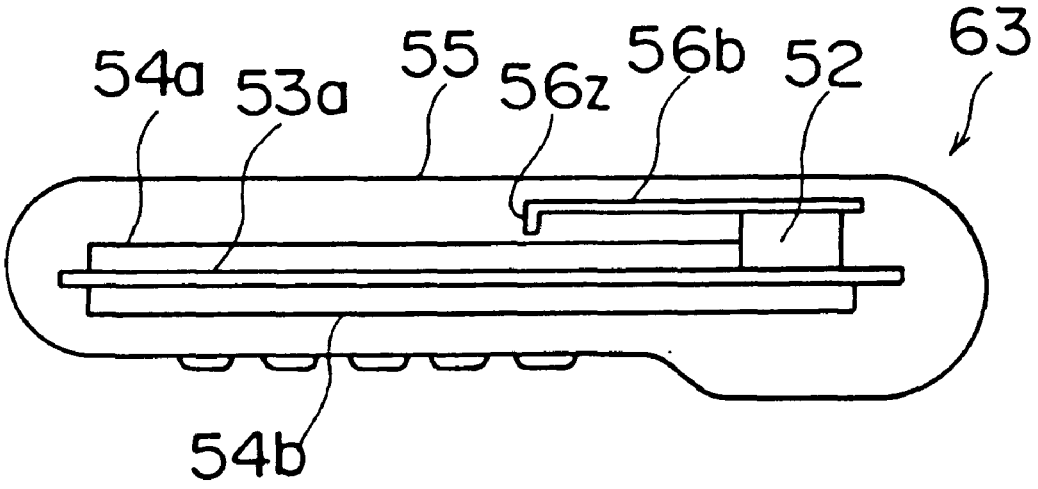
FIG. 11A is a side view showing the antenna device in which a power supplying portion and a radiating portion are brought into contact with each other.

FIG. 11A is a diagram for explaining an antenna device 51*c* according to a third embodiment of the present invention. The antenna device 51*c* is contained in a portable telephone 63. FIG. 11A illustrates the internal structure of the portable telephone 63 looked through a sheathing case. In FIG. 11A, the description with reference to FIG. 1 shall be incorporated by assigning the same portions as those shown in FIG. 1 the same reference numerals.

In FIG. 11A, the antenna device 51*c* has a radiating portion 56*b*. The radiating portion 56*b* is constructed by bending one edge of the radiating portion 56*a* in the first embodiment toward a main wiring substrate 53*a* comprising a ground electrode (not shown). This edge 56*z* is in close proximity to the ground electrode (not shown in FIG. 11A).

In the antenna device 51*c* according to the third embodiment, the edge 56*z* of the radiating portion 56*b* is in close proximity to the ground electrode 67*a* (see FIG. 2), whereby the distance between the radiating portion 56*b* and a portion at a ground potential is decreased. Consequently, the stray capacitance of the radiating portion 56*b* can be increased, thereby to make it possible to reduce the resonance frequency of the antenna device 51*c*.

Figure 11B:
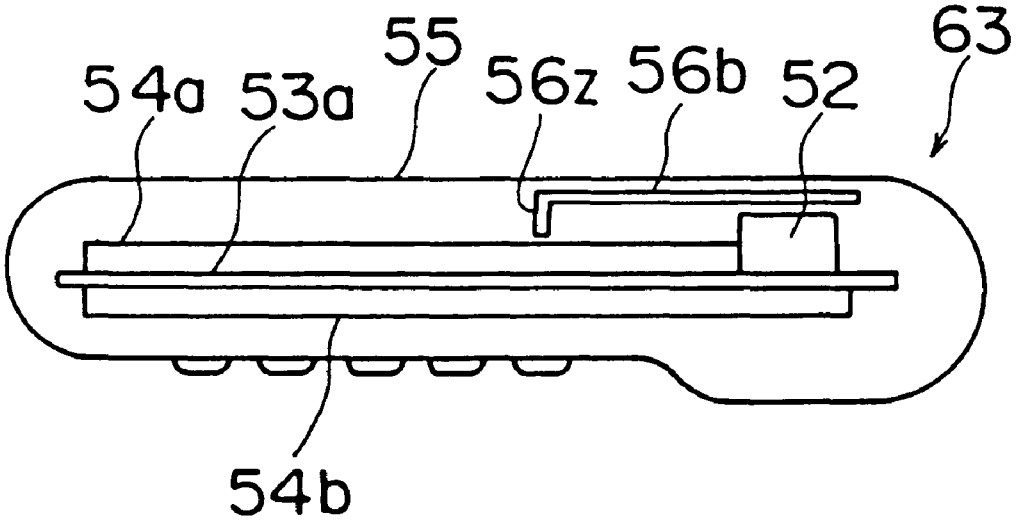
FIG. 11B is a side view showing the antenna device in which a power supplying portion and a radiating portion are spaced apart from each other by the distance at which they are electromagnetically connected to each other.

As shown in FIG. 11B, the radiating portion 56*b* may be arranged spaced apart from the power supplying portion 52 by the distance at which they can be electromagnetically connected to each other. Specifically, the construction shown in FIG. 11B is the same as the construction in the third embodiment shown in FIG. 11A except that the radiating portion 56*b* and the power supplying portion 52 are spaced apart from each other as in the second embodiment. Also in the antenna device according to the third embodiment, the same effect as the above described effect can be obtained by spacing the radiating portion 56*b* from the power supplying portion 52 by the distance at which they can be electromagnetically connected to each other.

The edge 56*z* can be constituted by at least a part or the whole of the edge of the radiating portion 56*b,* thereby to exhibit the same effect as the above described effect.

Figure 12A:
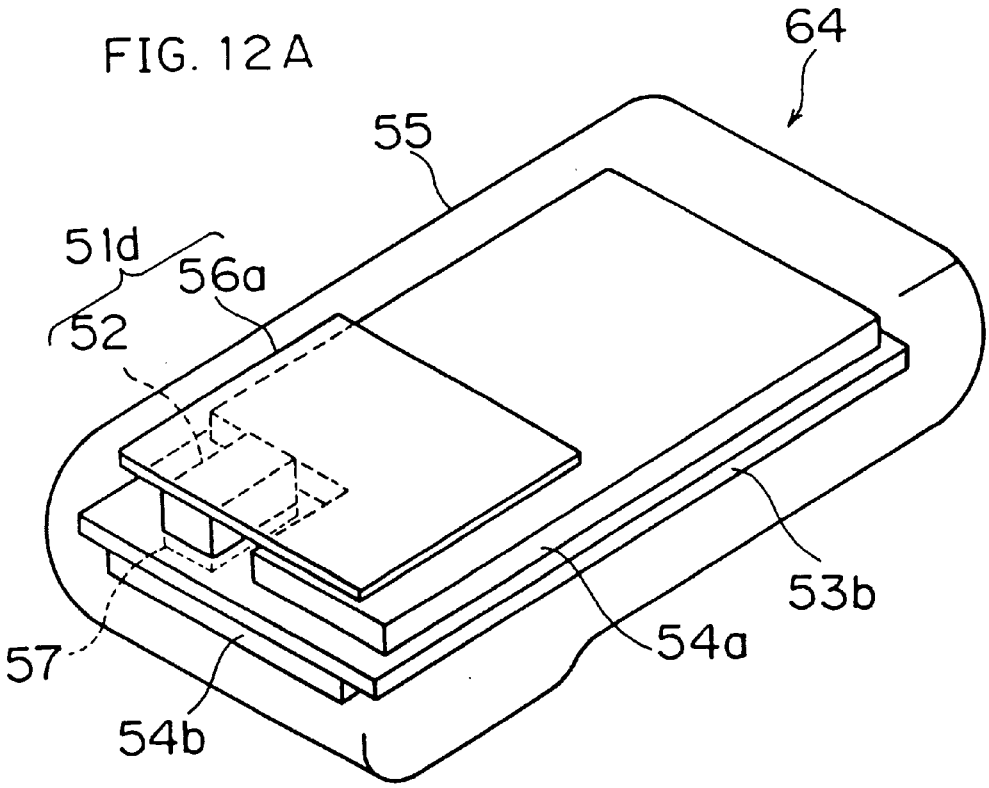
FIG. 12A is a perspective view.
Figure 12B:
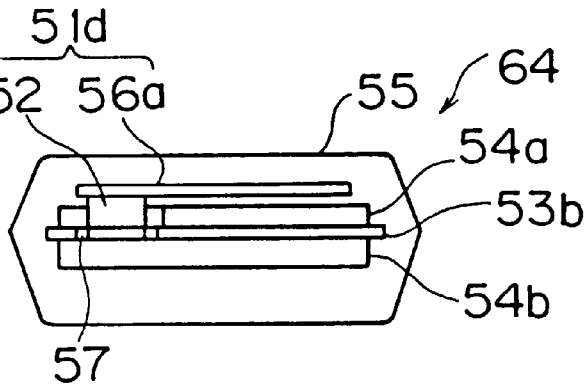
FIG. 12B is a front view.
Figure 12C:
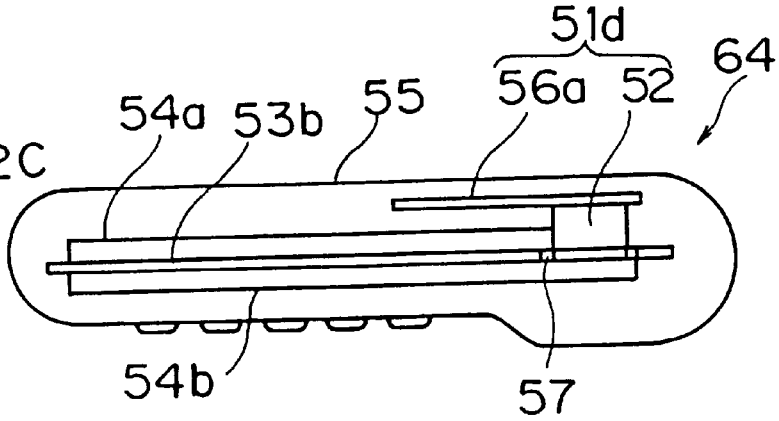
FIG. 12C is a side view.

FIG. 12 is a diagram for explaining an antenna device 51*d* according to a fourth embodiment of the present invention. In the present embodiment, the antenna device 51*d* is contained in a portable telephone 64. FIG. 12A is a perspective view showing the internal structure of the portable telephone looked through a sheathing case, FIG. 12B is a front view, and FIG. 12C is a side view. The description with reference to FIG. 1 shall be incorporated by assigning the same portions as those shown in FIG. 1 the same reference numerals.

In FIG. 12, in the antenna device 51*d,* a hole 57 is formed in a main wiring substrate 53*b.* A part of a power supplying portion 52 is inserted into the hole 57.

In the antenna device 51*d* according to the present embodiment, a part of the power supplying portion 52 is inserted into the hole 57, whereby the height of a portion, which is projected from the main wiring substrate 53*b,* of the power supplying portion 52 is decreased. Consequently, the height of a portion, which is projected from the main wiring substrate 53*b,* of the antenna device 51*d* is also decreased, thereby to make it possible to decrease the height of the portable telephone 64.

Figure 13A:
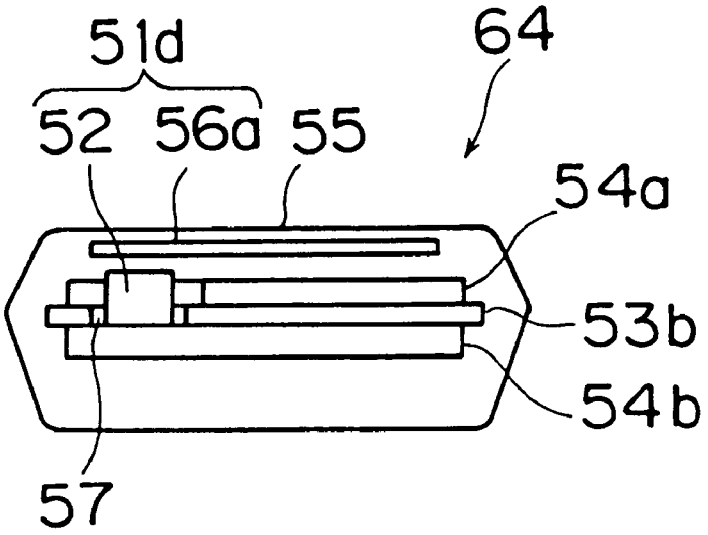
FIG. 13A is a front view.
Figure 13B:
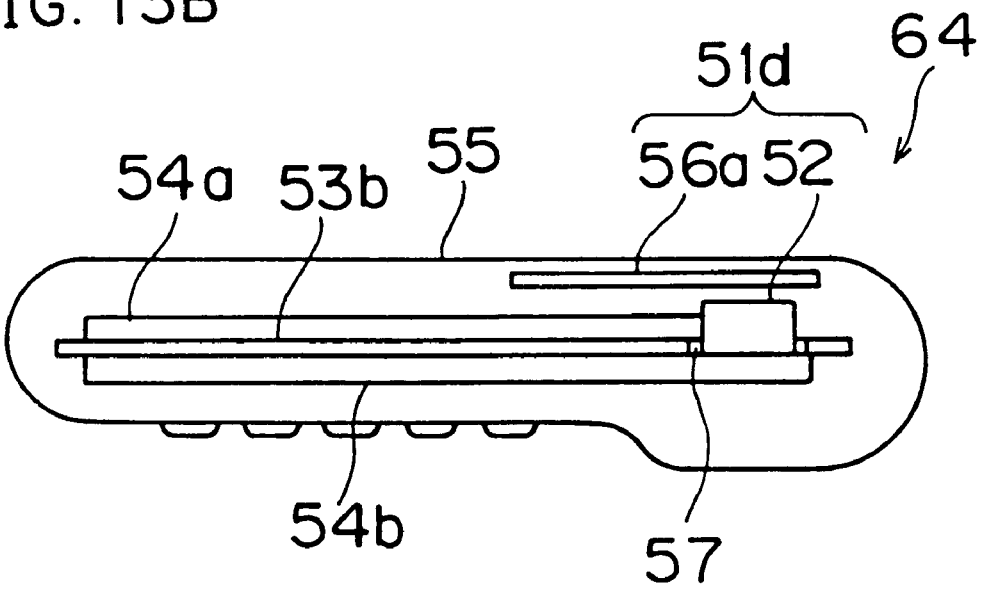
FIG. 13B is a side view.

As shown in FIGS. 13A and 13B, a main wiring substrate 53*b* may be constructed by forming a hole 57 in the main wiring substrate used in the second embodiment. Also in the case, a part of a power supplying portion 52 is inserted into the hole 57. Consequently, the height of a portion, which is projected from the main wiring substrate 53*b,* of the antenna device 51*d* can be decreased, as in the embodiment shown in FIG. 12. Further, the antenna device 51*d* may be deformed, similarly to the antenna device 51*c* according to the third embodiment shown in FIG. 11. Specifically, the antenna device 51*d* may be deformed by bending an edge of a radiating portion 56*a,* similarly to the radiating portion 56*b* in the antenna device according to the third embodiment.

Furthermore, a part of the power supplying portion 52 may be projected toward the reverse surface of the main wiring substrate 53*b* through the hole 57, thereby to make it possible to further decrease the height of the portable telephone 64.

Figure 14:
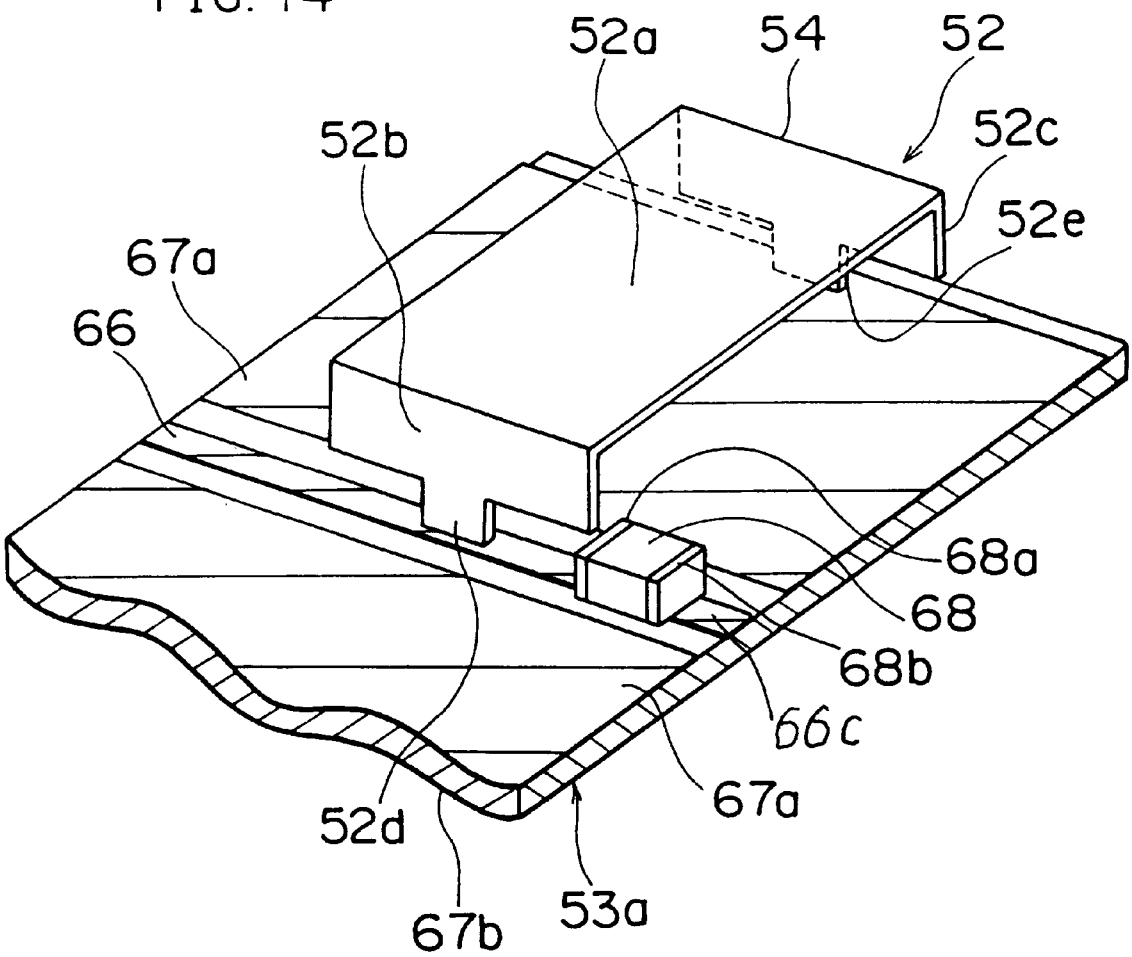
FIG. 14 is a partially cutaway view in perspective for explaining a power supplying portion and a capacitor in an antenna device according to a fifth embodiment of the present invention.

FIG. 14 is a partially cutaway view in perspective for explaining an antenna device 51*a* according to a fifth embodiment of the present invention, wherein a state where a power supplying portion and a capacitor are mounted on a main wiring substrate is illustrated. Portions other than portions where a power supplying portion 52 and a capacitor 68 are provided are constructed as in the first embodiment. Specifically, the present embodiment is the same as the first embodiment except that a portion where the power supplying portion 52 is provided which has the structure shown in FIG. 1 has a structure shown in FIG. 14. Consequently, the description of the first embodiment shall be incorporated with respect to the portions other than the power supplying portion 52 and the capacitor 68.

In the fifth embodiment, the power supplying portion 52 is constructed using a metal chassis 54 composed of a metal such as copper or a copper alloy. The power supplying portion 52 has a rectangular plate-shaped opposed portion 52*a* and two leg portions 52*b* and 52*c* formed by bending the opposed portion 52*a* downward from both ends on the side of its short sides. The opposed portion 52*a* is a portion opposed to a radiating portion 56*a*. A power supplying terminal 52*d* is integrally formed in an end of the leg portion 52*b,* while a ground terminal 52*e* is integrally formed in an end of the leg portion 52*c*.

A ground electrode 67*b* is formed on almost the whole reverse surface of the main wiring substrate 53*a*. In addition, a first microstrip line 66 is connected to an antenna switch circuit (not shown), for example, and is formed on the upper surface of a main wiring substrate 53*a*. A ground electrode 67*a* is further formed on the upper surface of the main wiring substrate 53 so as to be electrically insulated from the first microstrip line 66.

In assembling the power supplying portion 52, the metal chassis 54 is disposed on the surface of the main wiring substrate 53*a*. The power supplying terminal 52*d* and the first microstrip line 66 are soldered to each other, and the ground terminal 52*e* and the ground electrode 67*a* are soldered to each other, whereby the power supplying portion 52 is surface mounted on the main wiring substrate 53*a*.

The capacitor 68 is constituted by a monolithic type chip capacitor and is surface mounted on the main wiring substrate 53*a* in the present embodiment. Specifically, outer electrodes 68*a* and 68*b* of the capacitor 68 are soldered to the first microstrip line 66, whereby the capacitor 68 is surface mounted on the main wiring substrate 53*a*. In addition, a transmission output measuring terminal (not shown) of the antenna switch circuit is connected to the first microstrip line 66 through the capacitor 68 from the power supplying terminal 52*d*.

Although in the present embodiment, only the power supplying portion 52 is illustrated, the radiating portion 56*a* (see FIG. 1) may be provided in contact with the power supplying portion 52, or may be provided spaced apart from the power supplying portion 52 by the distance at which they can be electromagnetically connected to each other as in the second embodiment.

The shape of the power supplying portion 52 is not particularly limited, as in the first embodiment. The power supplying portion 52 can be in a suitable shape, provided that it comprises at least one power supplying terminal 52*d* and at least one ground terminal 52*e* and it can electrically or electromagnetically transmit a transmission radio wave output to the radiating portion 56*a*. For example, the power supplying portion 52 may be composed of a metal block. The positional relationship between the power supplying terminal 52*d* and the ground terminal 52*e* is not also limited to the relationship shown in FIG. 14. For example, the power supplying terminal 52*d* and the ground terminal 52*e* may be respectively formed on the side of the long sides of the power supplying portion 52.

Although in the present embodiment, the microstrip line is used as a transmission line, a high planar line or the like may be used.

Figure 15:
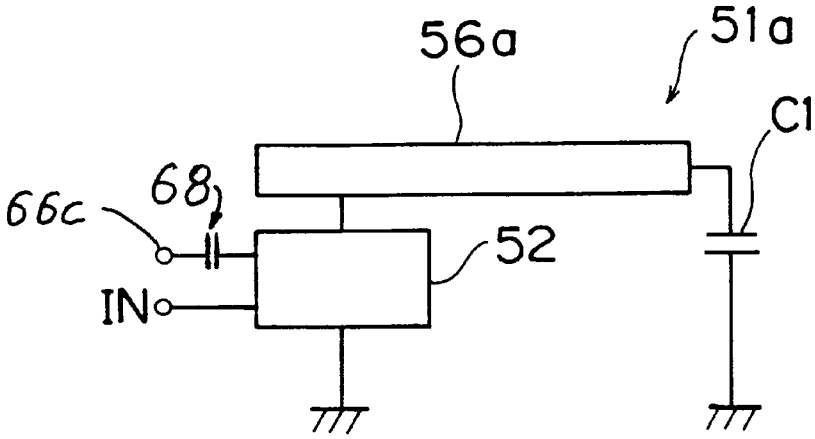
FIG. 15 is a block diagram showing the antenna device according to the fifth embodiment of the present invention.

FIG. 15 is a block diagram showing the electrical connection in the antenna device 51*a* according to the fifth embodiment. In FIG. 15, the power supplying portion 52 and the radiating portion 56*a* in contact with each other are electrically connected to each other, whereby a transmission output from the power supplying portion 52 is radiated from the radiating portion 56*a*. In addition, a transmission output measuring terminal is connected to the power supplying portion 52. C1 denotes the stray capacitance of the radiating portion 56*a*.

In the antenna device 51*a* according to the fifth embodiment, the power supplying portion 52 is provided on the main wiring substrate 53*a*, and the radiating portion 56*a* is arranged in a space between a sheathing case 55 and the main wiring substrate 53*a*, as in the first embodiment. Even after the power supplying portion 52 is mounted on the main wiring substrate 53*a*, therefore, it is possible to easily separate the radiating portion 56*a* from the power supplying portion 52 by removing the sheathing case 55 from the main wiring substrate 53*a*.

Furthermore, the above described transmission output measuring terminal is connected to the power supplying portion 52 through the capacitor 68. Consequently, the capacitance of the capacitor 68 is added to the transmission output from the power supplying portion 52 to the transmission output measuring terminal. Accordingly, the effect of the inductance of the power supplying portion 52 on a measured value of the transmission output from the power supplying portion 52 in the transmission output measuring terminal can be corrected by the above described capacitance. As a result, it is possible to accurately measure the transmission output from the antenna switch circuit without being affected by the inductance of the power supplying portion 52.

As described in the foregoing, even after the power supplying portion 52 is mounted on the main wiring substrate 53*a*, it is possible to separate the radiating portion 56*a* and easily and accurately measure the transmission output from the antenna switch circuit in a state where the antenna device 51*a* is removed which is regulated by radio wave law. Accordingly, it is possible to easily check the level of the transmission output at the time of shipment.

In order to measure the transmission output, an electrical or mechanical switch for switching the transmission output to the conventional transmission output measuring terminal is required. On the other hand, in the present embodiment, such a switch can be omitted, thereby to make it possible to reduce costs.

Figure 16:
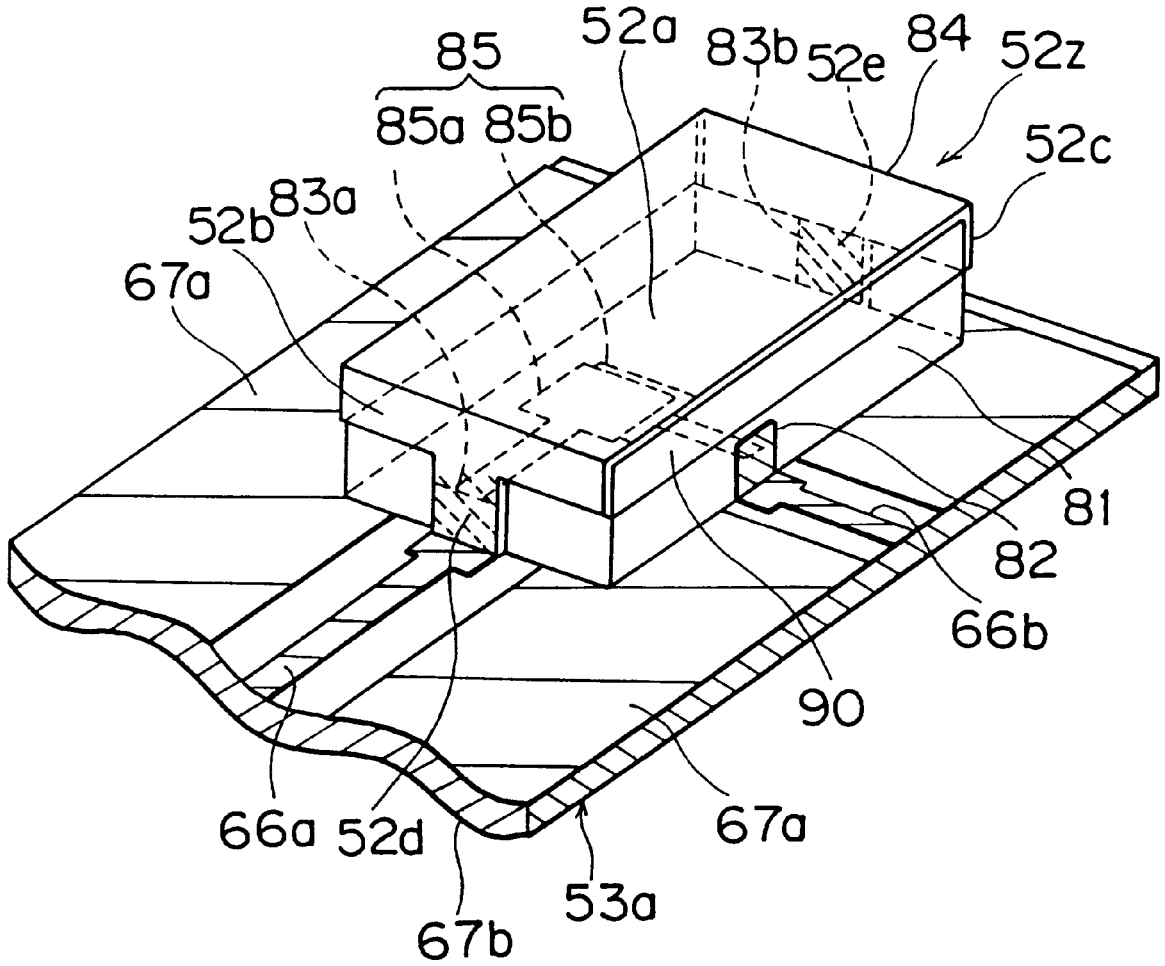
FIG. 16 is a partially cutaway view in perspective for explaining a power supplying portion and a capacitor used in an antenna device according to a sixth embodiment of the present invention.

FIG. 16 is a partially cutaway view in perspective for explaining portions where a power supplying portion and a capacitor are constructed in an antenna device 51*b* according to a sixth embodiment of the present invention. The description of the fifth embodiment shall be incorporated with respect to the other portions.

In the sixth embodiment, a first microstrip line 66*a* which is a first transmission line for supplying power to an antenna, a second microstrip line 66*b* which is a second transmission line for measuring a transmission output and a ground electrode 67*a* are formed on the upper surface of a main wiring substrate 53*a*.

The first microstrip line 66*a* and the second microstrip line 66*b* are arranged in a state where they are insulated from each other, and the microstrip lines 66*a* and 66*b* are formed in a state where they are also insulated from the ground electrode 67*a*. In addition, the second microstrip line 66*b* is connected to a transmission output measuring terminal (not shown in FIG. 16).

Reference numeral 81 denotes a rectangular parallelepiped dielectric substrate composed of ceramics or resin. A transmission output measuring electrode 82 is formed on one side surface on the side of the long sides of the dielectric substrate 81, while connecting electrodes 83*a* and 83*b* are formed on both side surfaces on the side of the short sides thereof. A first capacitor electrode 85*a* connected to the connecting electrode 83*a* and a second capacitor electrode 85*b* connected to the transmission output measuring electrode 82 are provided inside the dielectric substrate 81, thereby to construct a contained capacitor 85.

A metal chassis 84 is composed of copper or a copper alloy, for example. A power supplying terminal 52*d* and a ground terminal 52*e* are so formed as to have the same length as the thickness of the dielectric substrate 81. The lengths of leg portions 52*b* and 52*c* respectively including the power supplying terminal 52*d* and the ground terminal 52*e* are made larger than the thickness of the dielectric substrate 81.

In the case of assembling, the dielectric substrate 81 is inserted into the metal chassis 84. The side surfaces on the side of the short sides of the dielectric substrate 81 respectively abut against the inner surfaces of the power supplying terminal 52*d* and the ground terminal 52*e*. A space 90 is formed between an opposed portion 52*a* of the metal chassis 84 and the surface of the dielectric substrate 81. The connecting electrode 83*a* formed on the dielectric substrate 81 and the power supplying terminal 52*d* of the metal chassis 84 and the connecting electrode 83*b* formed on the dielectric substrate 81 and the ground terminal 52*e* of the metal chassis 84 are respectively joined to each other by solder.

The metal chassis 84 into which the dielectric substrate 81 is inserted is disposed on the surface of the main wiring substrate 53*a*. The power supplying terminal 52*d* and the first microstrip line 66*a*, the ground terminal 52*e* and the ground electrode 67*a*, and the transmission output measuring electrode 82 and the second microstrip line 66*b* are respectively soldered to each other, thereby to construct a power supplying portion 52*z*.

Figure 17:
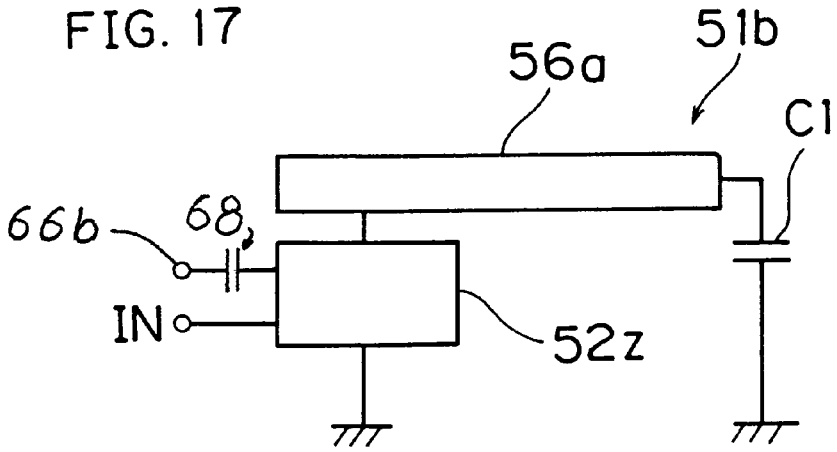
FIG. 17 is a block diagram showing the antenna device according to the sixth embodiment of the present invention.
Figure 18:
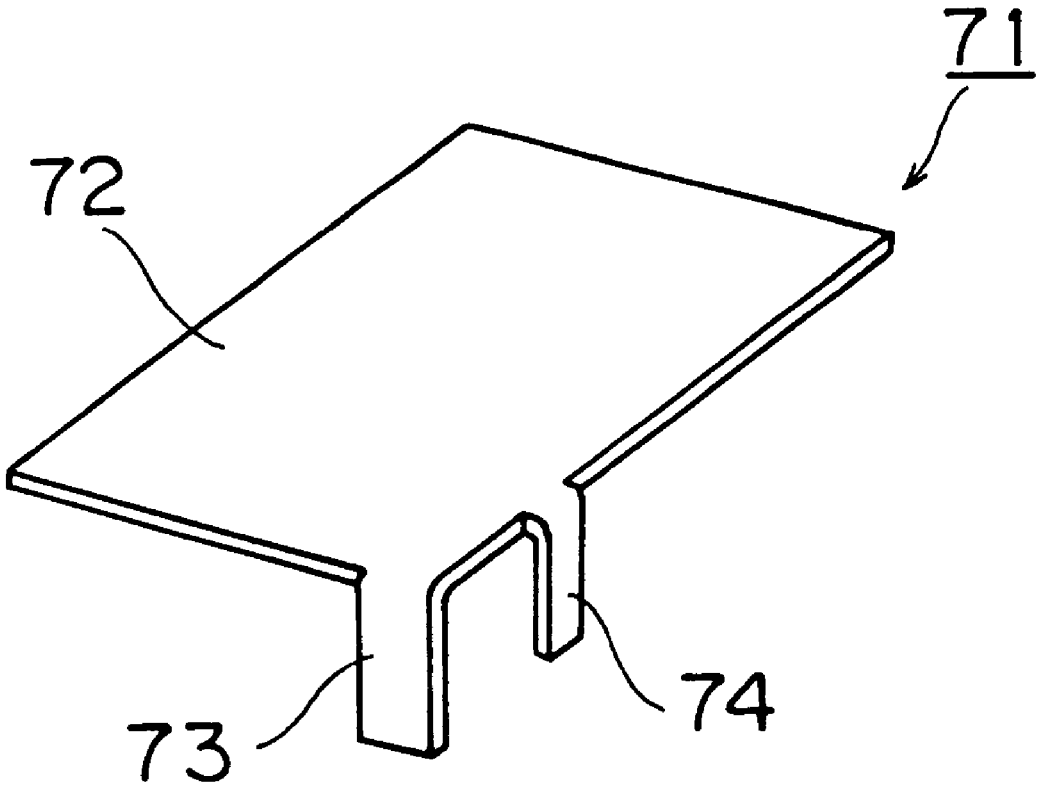
FIG. 18 PRIOR ART
FIG. 18 is a diagram showing an inverted-F antenna.

FIG. 17 is a block diagram showing the connection in the antenna device 51*b*. The same portions as those shown in FIG. 15 are assigned the same reference numerals and hence, the description thereof is not repeated. In FIG. 17, the power supplying portion 52*z* and the radiating portion 56*a* in contact with each other are electrically connected to each other, and a transmission radio wave output from the power supplying portion 52 is radiated from the radiating portion 56*a*. In addition, the above described transmission output measuring terminal is connected to the power supplying portion 52*z*.

The power supplying portion 52*z* thus constructed is provided on the main wiring substrate 53*a*, and the radiating portion 56*a* is arranged in a space formed between the main wiring substrate 53*a* and a sheathing case 55 containing the main wiring substrate 53*a* inside the sheathing case 55. In addition, the above described transmission output measuring terminal is connected to the power supplying portion 52*z* through the contained capacitor 85 in place of the monolithic type chip capacitor 68 in the power supplying portion 52 in the fifth embodiment. Accordingly, it is possible to obtain the same effect as the effect obtained by the above described fifth embodiment.

Furthermore, in the power supplying portion 52*z*, the dielectric substrate 81 is inserted into the metal chassis 84, whereby the capacitance of the power supplying portion 52*z* is increased, thereby to make it possible to reduce the resonance frequency of the antenna device 51*b*. Since the space 90 is provided between the opposed portion 52*a* of the metal chassis 84 and the surface of the dielectric substrate 81, an overcurrent in a ground plane caused by a magnetic field generated around a high frequency current flowing through the opposed portion 52*a* is restrained. In addition, an electric field caused by the magnetic field is not easily concentrated in the dielectric substrate 81. Consequently, the efficiency of transmitting a transmission output to the radiating portion 56*a* is further increased, thereby to further increase the gain of the antenna device 51*b*. Further, the contained capacitor 85 is formed inside the dielectric substrate 81, thereby to make it possible to adjust the impedance of the power supplying portion 52*z* in a designed manner. In surface mounting the power supplying portion 52*z* on the main wiring substrate 53*a*, therefore, a capacitance value of a capacitor connected to the power supplying portion 52*z* need not be selected and adjusted. Furthermore, it is possible to decrease the mounting area of the power supplying portion 52*z* on the main wiring substrate 53*a*.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna device comprising:

a main wiring substrate;

a power supplying portion provided on the main wiring substrate;

a sheathing case enclosing the main wiring substrate and the power supplying portion;

a radiating portion provided in a space between the main wiring substrate and the sheathing case, one major surface of said radiating portion being opposed to the power supplying portion;

a capacitor connected to said power supplying portion; and a transmission output measuring terminal connected to the capacitor;

a first transmission line for supplying power to the antenna on said main wiring substrate, said power supplying portion being connected to the first transmission line, said capacitor and said transmission output measuring terminal being connected to the first transmission line;

wherein said power supplying portion has a metal chassis and a dielectric substrate inserted into the metal chassis, said dielectric substrate has a first capacitor electrode connected to said first transmission line and a second capacitor electrode connected to a second transmission line for measuring a transmission output which is formed on said main wiring substrate, said first and second capacitor electrodes and the dielectric substrate constituting said capacitor connected to said transmission output measuring terminal.

2. The antenna device according to claim 1, wherein a space is provided between said metal chassis and the dielectric substrate.

3. The antenna device according to claim 2, wherein said power supplying portion is a surface mount antenna.

4. The antenna device according to claim 1, wherein said power supplying portion is a surface mount antenna.

5. An antenna device comprising:

a surface mount antenna for supplying an antenna signal; and a radiating element connected with said surface mount antenna for receiving and radiating said antenna signal, and separable from said surface mount antenna;

a capacitor; and a transmission output measuring terminal connected to said surface mount antenna through said capacitor:

wherein said surface mount antenna is connected to a first transmission line which is formed on a main circuit board and said surface mount antenna has a portion spaced away from said circuit board to supply said antenna signal, said capacitor is mounted on said main circuit board and having one end connected to said first transmission line, and said transmission output measuring terminal is connected to another end of said capacitor; and wherein said surface mount antenna comprises a dielectric substrate within a metallic chassis, said dielectric substrate having said capacitor incorporated therein and connected to said transmission output measuring terminal, said capacitor comprising a first capacitor electrode which is connected to said first transmission line, a second capacitor electrode which is connected to said transmission output measurement terminal, and a dielectric layer between said first and second capacitor electrodes.

6. An antenna device according to claim 5, wherein said dielectric layer of said incorporated capacitor is formed by a portion of said dielectric substrate.

7. An antenna device according to claim 5, wherein a space is provided between said metallic chassis and said dielectric substrate.

8. An antenna device according to claim 5, wherein said capacitor is a chip capacitor.

9. An antenna device comprising:

a surface mount antenna for supplying an antenna signal; and a radiating element connected with said surface mount antenna for receiving and radiating said antenna signal, and separable from said surface mount antenna;

a capacitor; and a transmission output measuring terminal connected to said surface mount antenna through said capacitor;

wherein said radiating element is accommodated in a gap formed between a main circuit board on which said surface mount antenna is mounted and an outer case in which said main circuit board is accommodated, one major surface of said radiating element facing a portion of said surface mount antenna which is spaced away from said circuit board; and wherein said surface mount antenna comprises a dielectric substrate within a metallic chassis, said dielectric substrate having said capacitor incorporated therein and connected to said transmission output measuring terminal, said capacitor comprising a first capacitor electrode which is connected to a first transmission line, a second capacitor electrode which is connected to said transmission output measurement terminal, and a dielectric layer between said first and second capacitor electrodes.

10. An antenna device according to claim 9, wherein said surface mount antenna is connected to said first transmission line which is formed on said main circuit board to supply said antenna signal, said capacitor is a chip capacitor mounted on said main circuit board and having one end connected to said first transmission line, and said transmission output measuring terminal is connected to another end of said chip capacitor.

11. An antenna device according to claim 9, wherein said dielectric layer of said incorporated capacitor is formed by a portion of said dielectric substrate.

12. An antenna device according to claim 9, wherein a space is provided between said metallic chassis and said dielectric substrate.

* * * * *